US008162460B2

(12) United States Patent
Amma et al.

(10) Patent No.: US 8,162,460 B2
(45) Date of Patent: Apr. 24, 2012

(54) INKJET PRINTING HEAD AND INKJET PRINTING CARTRIDGE

(75) Inventors: Hiromasa Amma, Kawasaki (JP); Keiichiro Tsukuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1013 days.

(21) Appl. No.: 12/100,344

(22) Filed: Apr. 9, 2008

(65) Prior Publication Data

US 2008/0252705 A1 Oct. 16, 2008

(30) Foreign Application Priority Data

Apr. 11, 2007 (JP) ..... 2007-104241

(51) Int. Cl.
*B41J 2/175* (2006.01)
*B41J 2/21* (2006.01)
*B41J 2/05* (2006.01)

(52) U.S. Cl. ..... 347/87; 347/43; 347/66

(58) Field of Classification Search ..... 347/15, 347/40, 43, 65, 66, 85, 86
See application file for complete search history.

(56) References Cited

U.S. PATENT DOCUMENTS 5,208,605 A * 5/1993 Drake ..... 347/15
5,969,739 A * 10/1999 Altendorf et al. ..... 347/87
6,457,796 B1 * 10/2002 Fujii ..... 347/12
6,830,317 B2 * 12/2004 Tsuchii et al. ..... 347/56
6,918,656 B2 * 7/2005 Koitabashi et al. ..... 347/56
6,976,748 B2 * 12/2005 Yabe et al. ..... 347/43

FOREIGN PATENT DOCUMENTS

| | | | |
|---|---|---|---|
| JP | 6126955 | | 5/1994 |
| JP | 2002240252 | | 8/2002 |
| JP | 2004-009744 | A | 1/2004 |
| JP | 2004122533 | | 4/2004 |
| JP | 2005-349605 | A | 12/2005 |
| JP | 2007-022036 | A | 2/2007 |
| JP | 2007-98903 | * | 4/2007 |
| WO | 2006055643 | A2 | 5/2006 |

* cited by examiner

*Primary Examiner* — Anh T. N. Vo

(74) *Attorney, Agent, or Firm* — Canon USA Inc IP Division

(57) ABSTRACT

An inkjet printing cartridge capable of ejecting miniaturized ink droplets in a stable manner while avoiding the complexity of the structure and control as well as suppressing the cost rise. For this purpose, the inkjet printing cartridge is formed of a material having the permeability to liquid and gas, and the ink supply path for supplying ink to the ejection opening having a relatively small ejection amount is arranged adjacent to other ink supply paths via walls.

11 Claims, 16 Drawing Sheets

| DIAMETER OF EJECTION ORIFICE | INK EJECTION AMOUNT(ng) | EJECTION INTERVAL(sec) | | |
|---|---|---|---|---|
| | | 0% EVAPORATION INK | 2% EVAPORATION INK | 10% EVAPORATION INK |
| LARGE $\phi 17\mu m$ | 5.7 | 6 | 6 | 5 |
| SMALL $\phi 11\mu m$ | 2.4 | 3 | 3 | 2 |

FIG.8

INKJET PRINTING HEAD AND INKJET PRINTING CARTRIDGE

BACKGROUND OF THE INVENTION

1. Field of the Invention

The present invention relates to an inkjet printing head and an inkjet printing cartridge applicable to a printing device for carrying out the printing by ejecting liquid such as ink.

2. Description of the Related Art

Printing heads used for an inkjet printing device for carrying out the printing by ejecting ink are classified to several kinds in accordance with methods for ejecting ink. Of them, a printing head of a thermal system applies a driving energy to a heat element to generate the film boiling in ink, resulting in the ejection of ink from an ejection opening due to a pressure caused by the film boiling to complete the printing.

Generally, the printing head includes a plurality of ejection openings for ejecting ink, ink paths communicated with these ejection openings, and heating elements arranged opposite to the ejection openings. Further, the printing head has rows of ejection openings wherein a plurality of ejection openings are arranged to form rows, connected to a common ink chamber via ink supply ports communicated with the ink paths. The common ink chamber is also communicated to an ink supply path provided in a tank case forming an ink storing section so that ink is supplied from the ink storing section sequentially to the ink supply path, the common ink chamber, and the ink paths.

In such a printing head, since the ink is in contact with outer air via the ejection openings, there may be a risk in that the moisture in the ink evaporates to increase the ink viscosity. If the ink viscosity increases in such a manner, there may be a risk in that the ejection of ink becomes unstable. Particularly, first ink ejection after the interruption of ink ejection for a while becomes unsmooth since the ink viscosity increases in the vicinity of the ejection opening due to the evaporation. That is, when an interval between the succeeding ejections becomes long, the moisture in the ink in the vicinity of the ejection opening evaporates to worsen the easiness of ink ejection. If the state of ejection changes in such a manner due to the variation of the ejection interval, there may be a risk in that the printing on a medium is also variable to lower the printing quality.

Also, it has been known that the moisture in the ink evaporates via resin forming an ink storage section to thicken the ink. Since the colorant concentration changes if the moisture in ink evaporates via the ejection opening or the resin forming the ink storage section, there is a risk in that the color density or color tone of the recording printed on a printing medium changes to worsen the quality of the recording. To avoid such the degradation of the recording, various means have been adopted. In Japanese Patent Laid-Open No. H6-126955, a technology is disclosed wherein the evaporation moisture in ink is avoided by providing a valve on an ejection opening side within an ink path. This valve has a pair of electro-conductive elastic bodies covered with an insulating layer and arranged up and down opposite to each other. By applying voltage to these electro-conductive elastic bodies, the elastic bodies are stretched by the static force added thereto.

In Japanese Patent Laid-Open No. 2004-122533, a structure is proposed wherein the ejection energy added to the printing head is variable by means of a drive signal control section in accordance with time intervals for exposing the ejection opening of the printing head. That is, by changing a pulse width of a driving signal for the printing head, viscous ink in the vicinity of the ejection opening caused by the exposure of the ejection opening is ejected.

In Japanese Patent Laid-Open No. 2002-240252, a structure is proposed wherein the inner temperature of the printing head is detected and, in accordance with the detected temperature, the inner temperature thereof is adjusted. By controlling the inner temperature of the inkjet printing head so that the optimum ejection of ink is obtained, the stable ejection is achievable.

The recent inkjet printing head has been quickly improved in performance such as the printing quality, the printing speed or others. To improve the printing quality, it is necessary to use various kinds of ink, miniaturize ink droplets, and arrange the ink ejection openings at a high density in correspondence to the miniaturized ink droplets. Also, in a printing device carrying out the printing operation by the reciprocation scanning of the inkjet printing head on the printing medium, to accelerate the printing speed, it is necessary to either widen a printing area covered with a single scan by increasing the number of ejection openings or use a higher ejection driving frequency so that more ink droplets are ejected.

To miniaturize the ink droplet, it is necessary to reduce the driving energy to be applied to the heat element or minimize an open area of the ejection opening. If the driving energy to be applied to the heat element is reduced, the easiness of the ejection becomes worse after a predetermined period has passed since the amount of ejected ink as well as the ejection speed is lowered. Also, if the open area of the ejection opening is minimized, a flow resistance of the ink to be ejected increases to worsen the easiness of ejection after the passage of the predetermined time interval. Namely, while the easiness of ejection is worsened by the evaporation of moisture in ink after the passage of the predetermined time interval as described before, it is also worsened by the reduction of the driving energy applied to the heat element or the minimization of the open area of the ejection opening.

As a countermeasure thereto, Japanese Patent Laid-Open No. H6-126955 proposes a structure wherein a valve is provided in the ink path to restrict the moisture evaporation from the ejection opening to prevent the easiness of ejection from being worsened after the passage of the predetermined time period. If the driving energy applied to the heating element is reduced, however, it is difficult to restrict the deterioration of the ink ejection caused by the deceleration of the ink-ejection speed after the predetermined time passage unless any means is taken. Also, when the open area of the ejection opening is minimized, it is difficult to restrict the deterioration of the ejection easiness after the predetermined time passage due to the increase of the flow resistance unless any means is adopted as described hereinabove.

As means for recovering a state wherein the ejection easiness becomes worse after the predetermined time has passed when the driving energy to be applied to the heat element is reduced or the open area of the ejection opening is minimized, the preliminary ejection of ink is generally adopted, which does not contribute to the printing and is carried out while avoiding the printing medium. Accordingly, as the ink droplet is smaller, the ejection easiness after the predetermined time has passed becomes worse, which results in the increase in the number of the preliminary ejection as well as an amount of ink not contributed to the printing operation. This causes a risk of increase in cost due to the increase in amount of contained ink, or increase in the running cost due to the reduction of an amount of ink usable by the user for the printing operation.

According to the structure disclosed in Japanese Patent Laid-Open No. H6-126955, since the valve is provided in the respective ejection opening, the cost is extremely high. Whereby, if the number of ejection openings is increased for the purpose of accelerating the printing speed, further rise in the cost is expected.

On the other hand, the control of the driving signal for the inkjet printing head or the control of the internal temperature proposed in Japanese Patent Laid-Open Nos. 2004-122533 and 2002-240252 is effective for restricting the deterioration of the ejection easiness after the predetermined time has passed caused by the reduction of the amount of ejected ink. There is a risk, however, in that, if it is desired to increase kinds of ink or the number of ejection openings, items to be controlled increase, resulting in the complexity of the structure and/or control.

SUMMARY OF THE INVENTION

The present invention is directed to an inkjet printing head and an inkjet printing cartridge capable of ejecting miniaturized ink droplets in a stable manner while suppressing the cost rise as well as avoiding the complexity of the structure and/or the control.

According to an aspect of the present invention, there is provided an inkjet printing head including an ink ejecting section having a plurality of ejection openings configured to eject a plurality of kinds of inks at different ejection amounts, a common ink chamber provided with respect to the respective kind of ink and configured to supply the ink to the plurality of ejection openings, and ink supply paths facilitating supplying the respective ink to the common ink chamber. The ink supply path for the ink ejected from the ejection opening having a relatively small ejection amount is adjacent to the another ink supply path via a wall.

According to another aspect of the present invention, there is provided an inkjet printing head including an ink ejecting section having a plurality of ejection openings configured to eject a plurality of kinds of inks at different ejection amounts, a common ink chamber provided with respect to the respective kind of ink and configured to supply the ink to the plurality of ejection openings, an ink supply path facilitating supplying the ink to the common ink chamber, and first and second walls in contact with outer air. The first walls form the ink supply path for the ink ejected from the ejection opening having a relatively small ejection amount. The first walls have an a real ratio smaller than that of the second walls forming the ink supply path for the ink ejected from the ejection opening having a relatively large ejection amount.

According to the present invention, in a path for supplying ink from an ejection opening capable of ejecting a relatively small amount of ink in a group of a plurality of ejection openings, an amount of moisture evaporated from the ink is restricted. Thereby, it is possible to obtain an inkjet printing head and an inkjet printing cartridge capable of restricting the deterioration of the ejection easiness in the ejection opening having a small ejection amount, suppressing the cost rise, avoiding the complexity of structure or control and ejecting miniaturized ink droplet in a stable manner.

Further features of the present invention will become apparent from the following description of exemplary embodiments (with reference to the attached drawings).

BRIEF DESCRIPTION OF THE DRAWINGS

FIG. 8 is a table showing the estimation of the ejection easiness of the first embodiment after a predetermined time has passed, when magenta ink is used;

DESCRIPTION OF THE EMBODIMENTS

First Embodiment

A first embodiment according to the present invention will be explained below with reference to the attached drawings.

Figure 1:
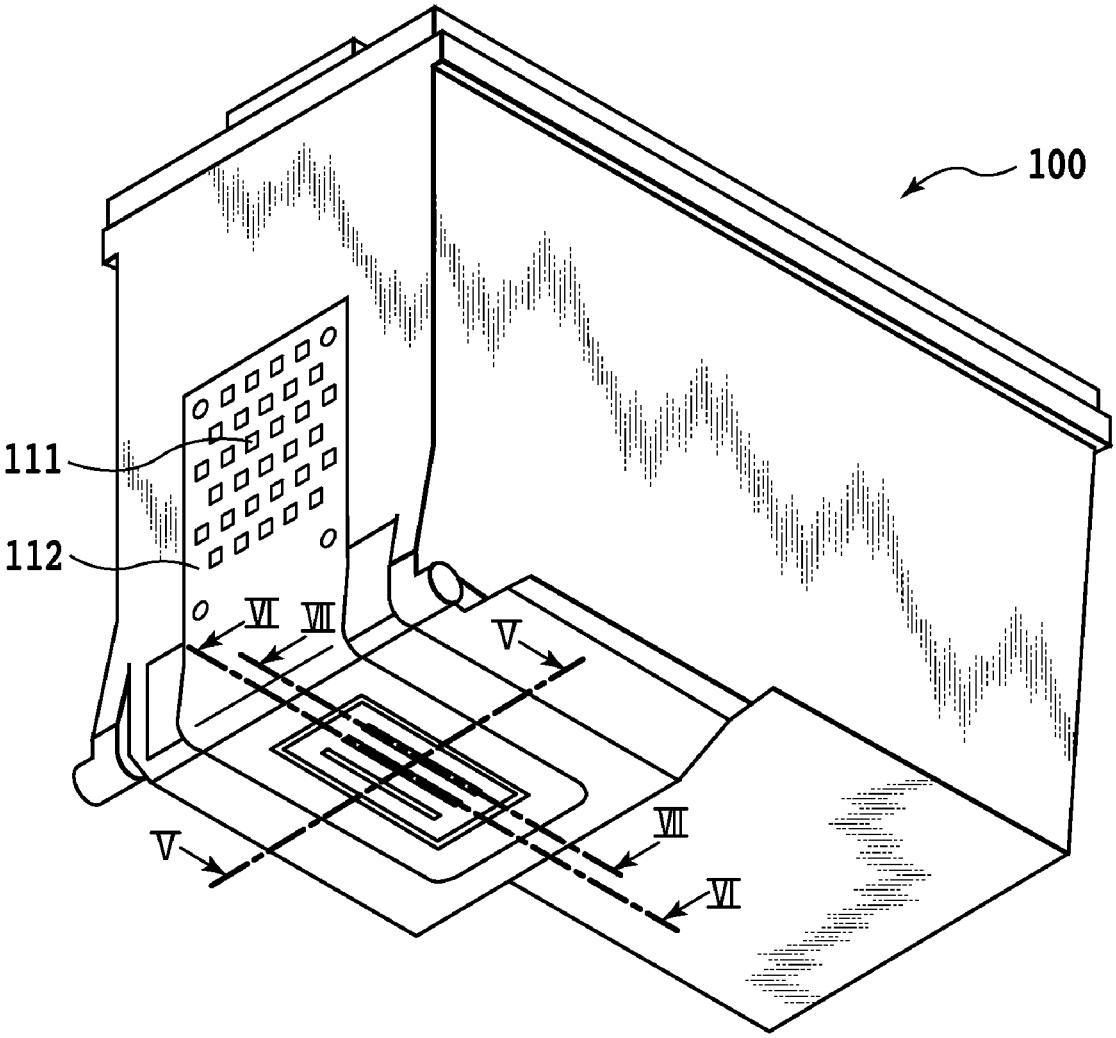
FIG. 1 is a perspective view of an appearance of an inkjet printing cartridge according to a first embodiment of the present invention.

FIG. 1 is a perspective view illustrating an appearance of an inkjet printing cartridge 100 according to this embodiment. An inkjet printing head 101 carrying out the printing operation by ejecting ink is provided in an ink ejecting section at a lower position of the inkjet printing cartridge 100. On the side surface of the inkjet printing cartridge 100, a contact section 111 having electric contacts for receiving driving signals or other from an inkjet printing device (not shown) is provided. The contact section 111 and the inkjet printing head 101 are electrically connected to each other via an electric wiring tape 112.

Figure 2:
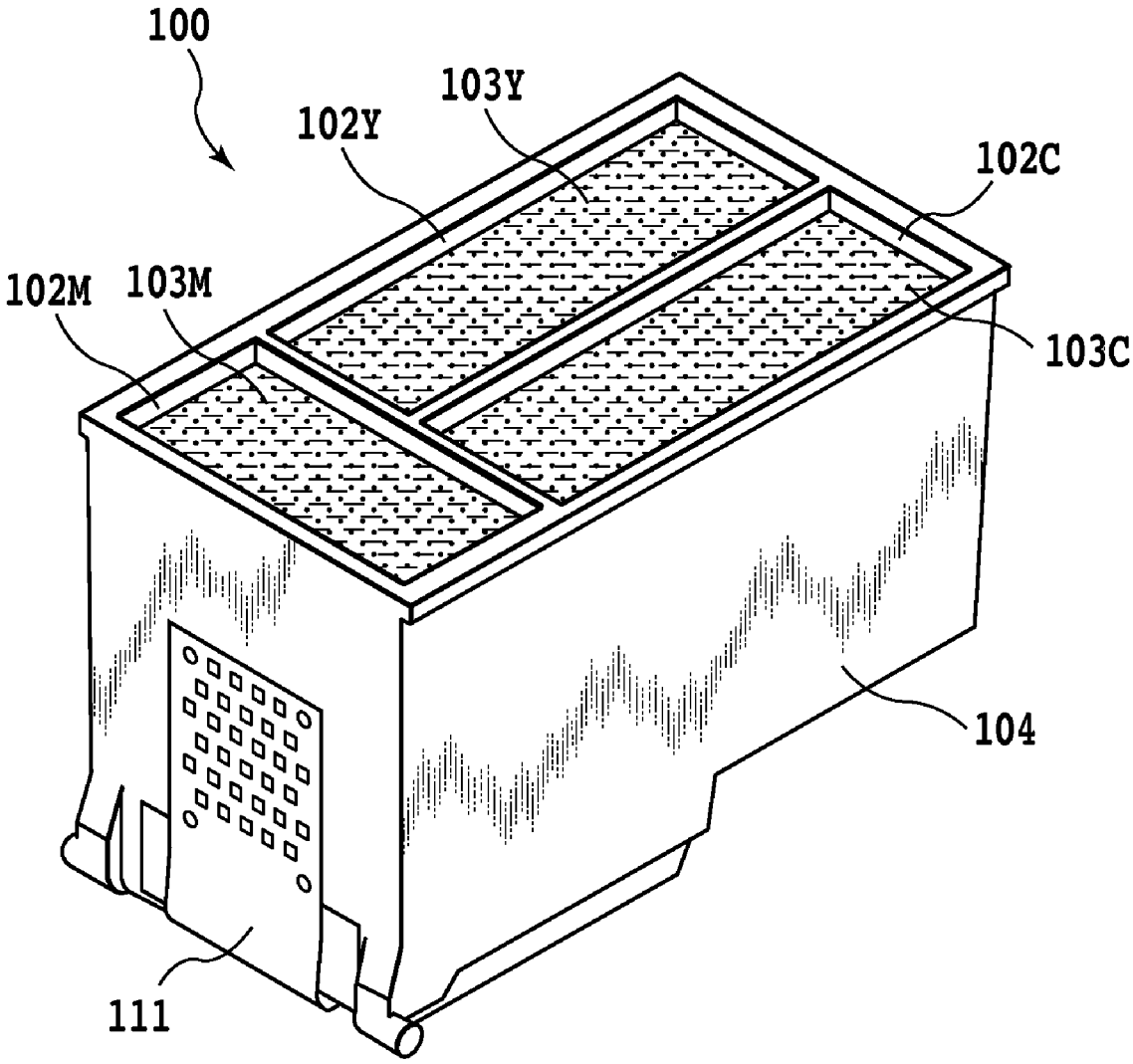
FIG. 2 is a perspective view of the inkjet printing cartridge in a state wherein a tank cover is removed.

FIG. 2 is a perspective view illustrating the inkjet printing cartridge 100 from which is removed a tank cap. The inkjet printing cartridge 100 according to this embodiment is capable of storing a plurality of kinds of ink: cyan, magenta and yellow. The cartridge 100 is provided with an ink storage section and an ink supply path in correspondence to the respective ink. In this regard, according to this embodiment, while the inkjet printing cartridge is provided with the ink storage section therein, it may be structured so that ink tanks are separately prepared to be mountable thereto.

In the inkjet printing cartridge 100, ink storage sections 102C, 102M, and 102Y for storing the respective color inks are formed by dividing a tank case 104 in a T-form. In the respective ink storage sections 102C, 102M, and 102Y, ink absorbers 103C, 103M, and 103Y are provided for containing and reserving the respective inks.

Figure 3:
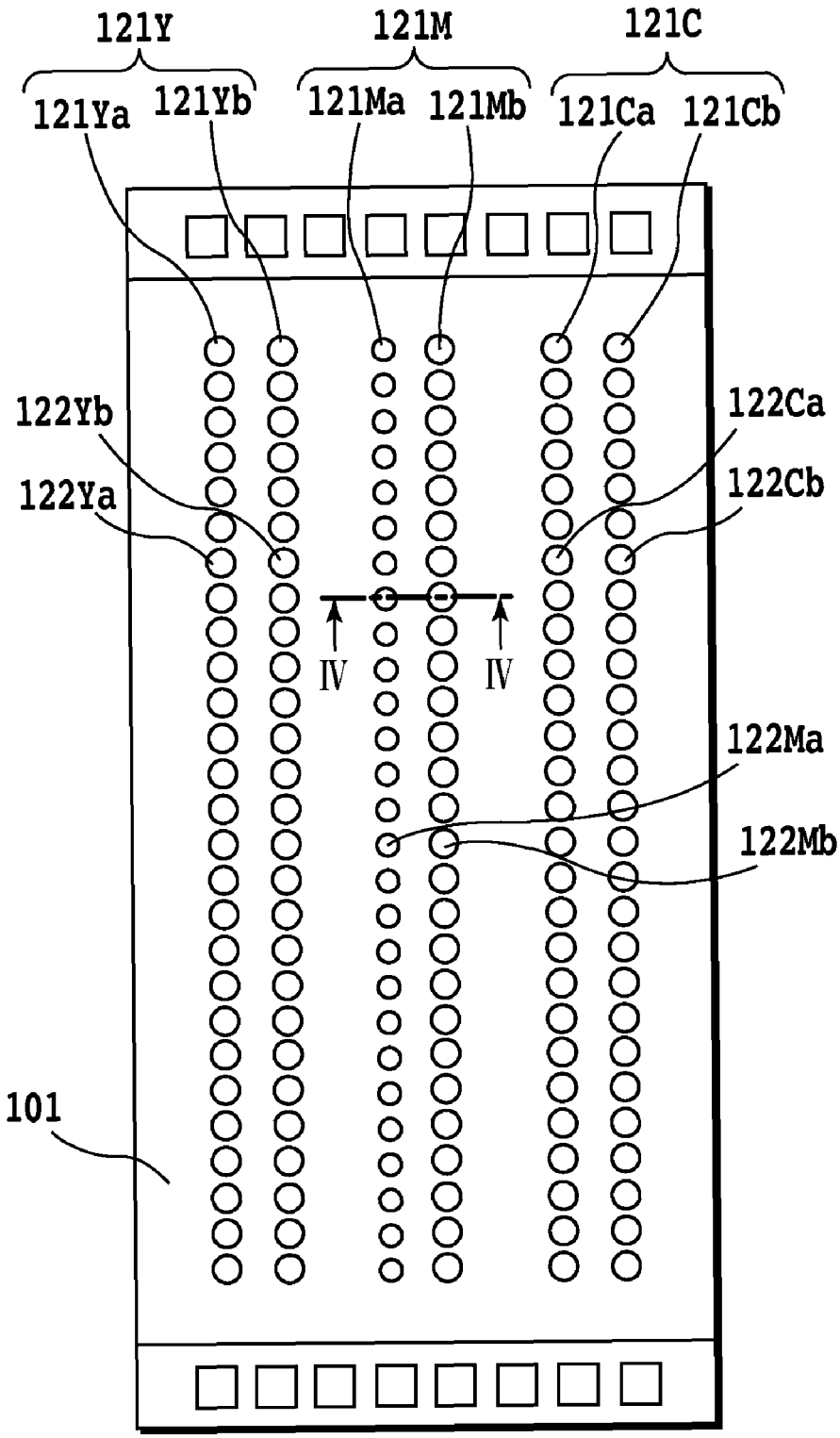
FIG. 3 is a plan view of an inkjet printing head.
Figure 4:
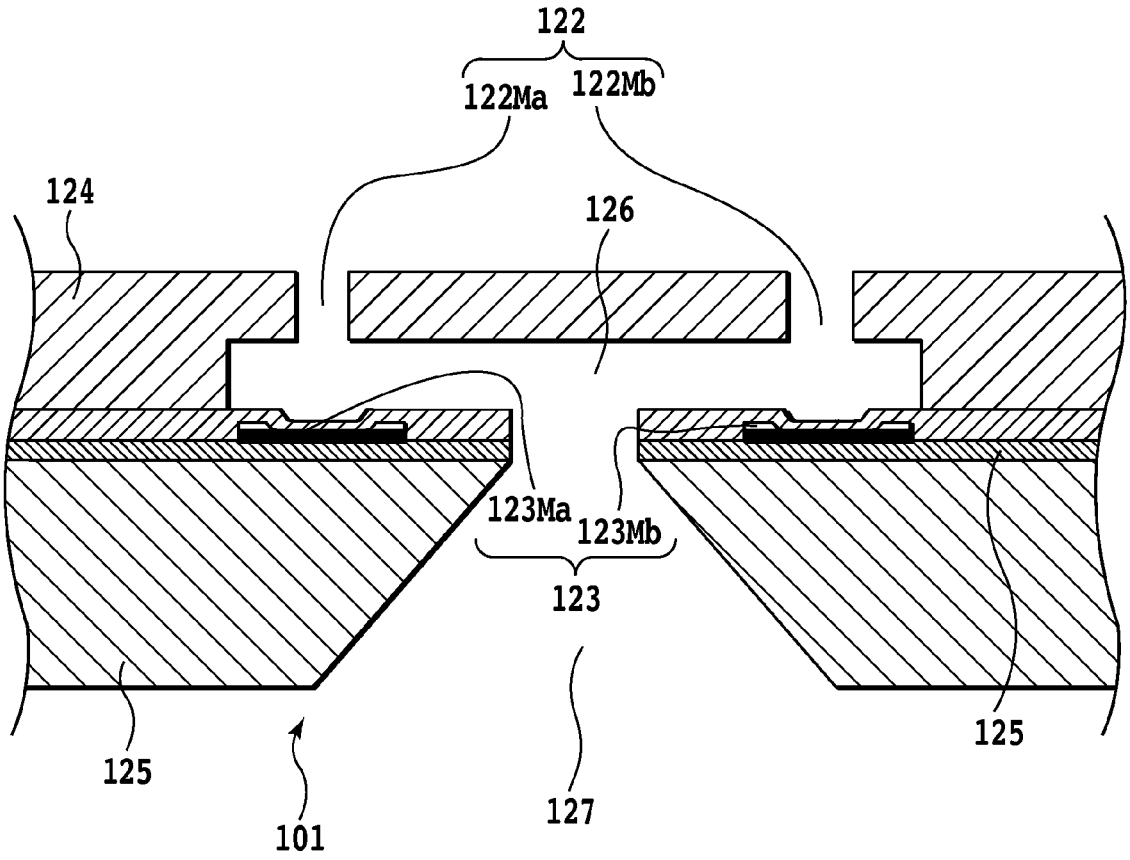
FIG. 4 illustrates a cross-section taken along a line □-□ in FIG. 3.

FIG. 3 is a plan view of the inkjet printing head 101, and FIG. 4 is a cross-section taken along a line IV-IV in FIG. 3. As described above, according to this embodiment, the inks of cyan, magenta, and yellow are used and two rows 121C, 121M, and 121Y of ejection openings are provided in correspondence to the respective ink. Of them, solely for the magenta ink, small ejection openings 121Ma capable of ejecting a small amount of ink droplets are provided. The respective ejection opening has a circular shape, and in the rows 121Ma and 121Mb for ejecting magenta ink, having the ejection openings different in diameter from each other, a diameter of the smaller ejection opening 122Ma is 11 μm and that of the larger ejection opening 122Mb is 17 μm. On the other hand, diameters of the ejection openings 122Ya, 122Yb, 122Ca, and 122Cb for ejecting cyan and yellow inks, respectively, are 17 μm, which is the same as that of the larger ejection opening 122Mb for ejecting magenta ink.

As shown in FIG. 4, a heating element 123 for generating ink ejection energy is layered between a protection film 124, for protecting the heating element 123, and an insulation film 125, and positioned beneath the ink ejection opening 122. Also, an ink path 126 for supplying ink to the ejection opening 122 is connected to a common ink chamber 127 formed in the inkjet printing head 101. Here, while FIG. 4 shows a cross-section of the ejection openings 122Ma and 122Mb for ejecting magenta ink, the other ink ejection openings have the same structure.

By applying the driving energy having a voltage of 24V and a current of 0.05 A for 0.8 μsec to the heating elements 123Ma and 123Mb, the ejection opening 122Ma ejects ink of about 5.7 ng per drop, and the ejection opening 122Mb ejects ink of about 2.4 ng per drop. The ejection openings 122Ya, 122Yb, 122Ca, and 122Cb for ejecting cyan and yellow inks, respectively, eject ink of about 5.7 ng per drop.

Figure 5:
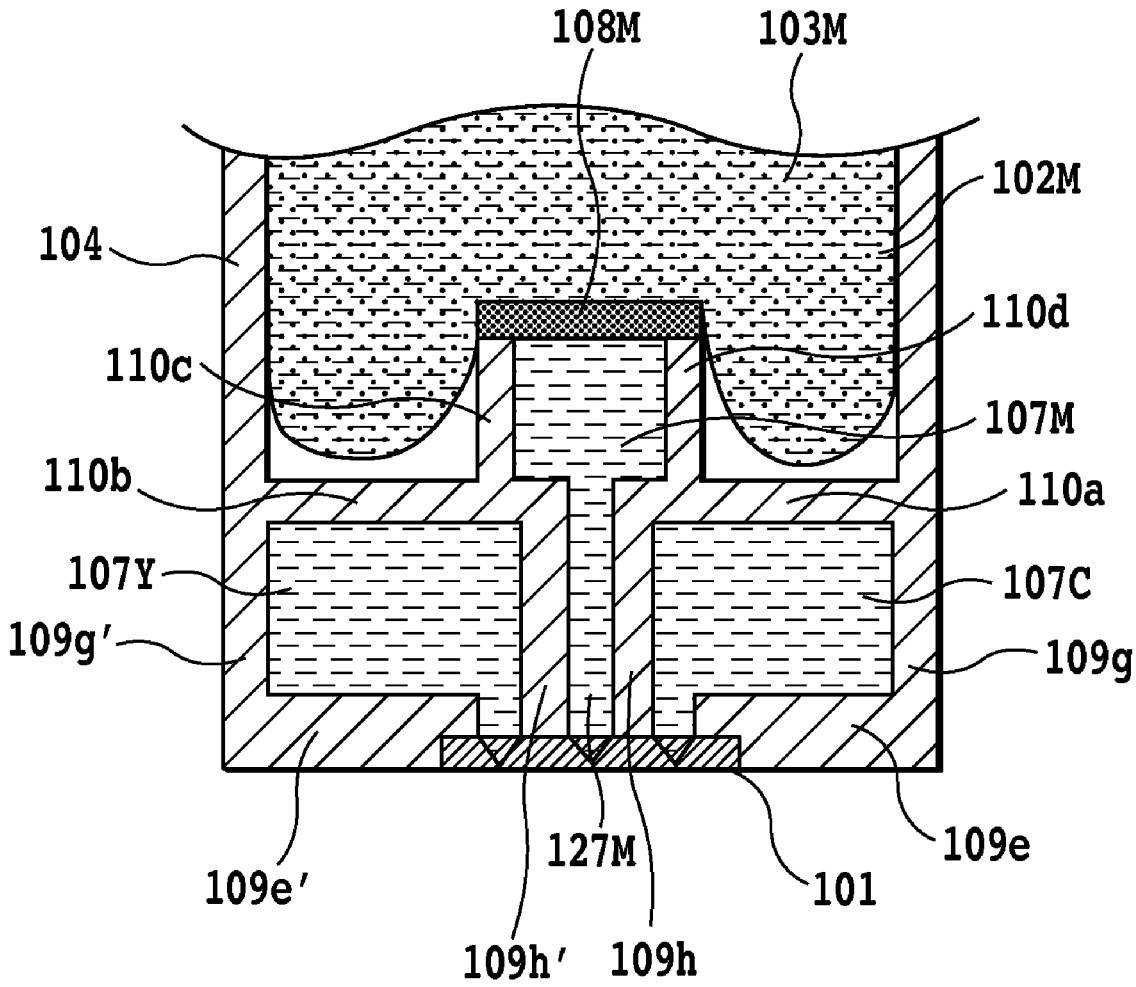
FIG. 5 illustrates a cross-section taken along a line V-V in FIG. 1.
Figure 6:
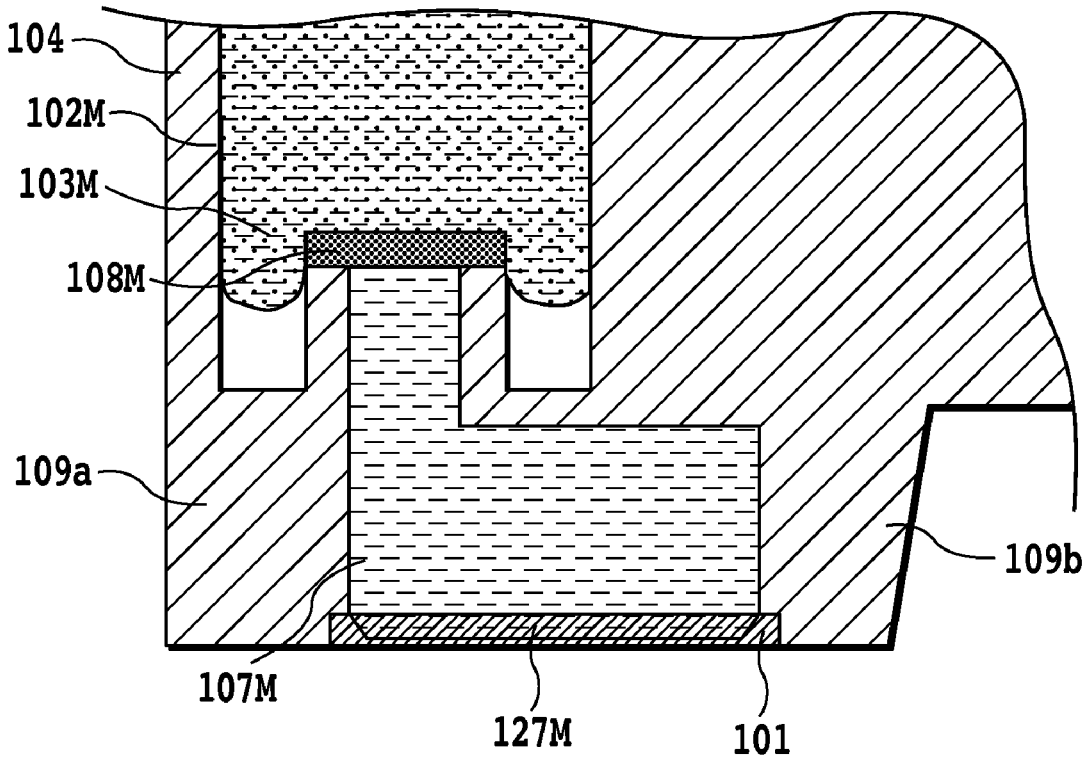
FIG. 6 illustrates a cross-section taken along a line VI-VI in FIG. 1.
Figure 7:
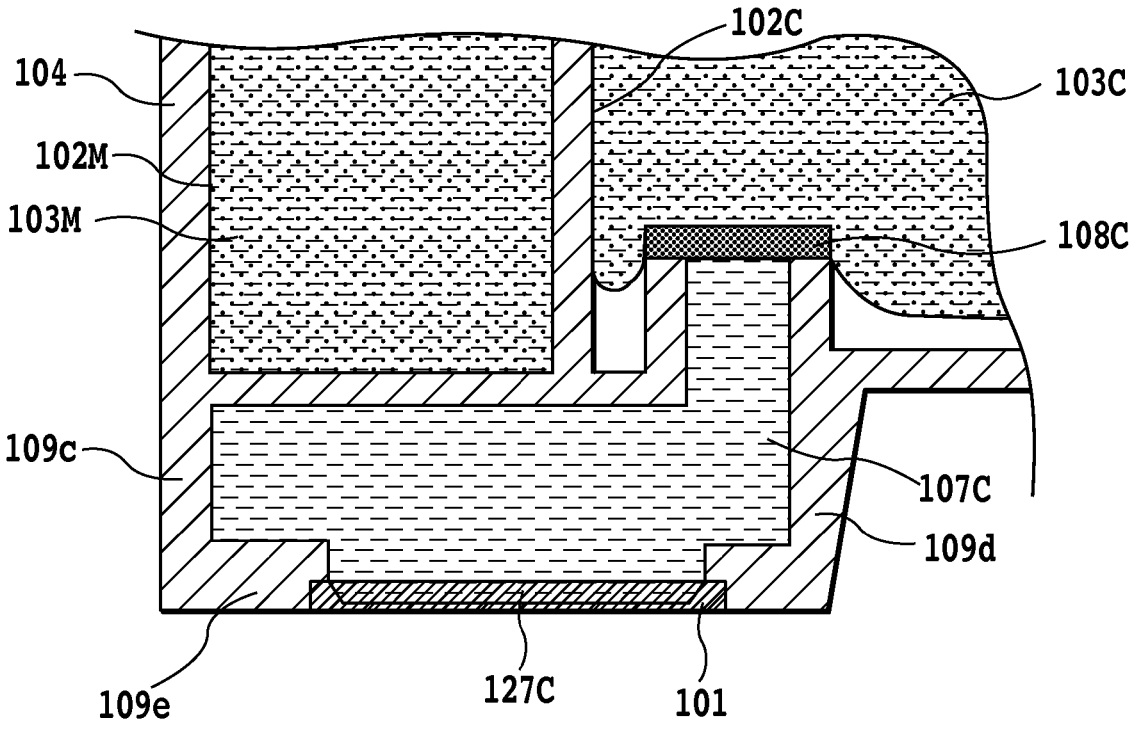
FIG. 7 illustrates a cross-section taken along a line VII-VII in FIG. 1.

FIGS. 5 to 7 illustrate the cross-sections taken along lines V-V, VI-VI, and VII-VII in FIG. 1. In FIG. 5, it is possible to confirm ink supply paths 107M, 107C, and 107Y for magenta, cyan, and yellow color inks. The ink supply path 107M containing magenta ink is arranged between the ink supply paths 107C and 107Y containing cyan and yellow inks. Walls 109*g*, 109*g*', 109*e*, and 109*e*' forming the ink supply paths 107C and 107Y are those forming a contour of the inkjet printing cartridge 100, and in contact with outer air. Contrarily, since walls 109*h* and 109*h*' forming the ink supply path 107M are sandwiched on both sides between the ink supply paths 107C and 107Y, they are common to walls forming the ink supply paths 107C and 107Y. The ink supply paths 107C and 107Y are structured to have an inner volume larger than that of the ink supplying path 107M so that a larger amount of ink is contained therein.

As shown in FIGS. 5 and 6, the ink absorber 103M for reserving magenta ink is brought into contact with a filter 108M for preventing impurities from entering the inkjet printing head 101. Between the filter 108M and the inkjet printing head 101, the ink supply path 107M is provided for supplying ink from the ink storage section 102M, and connected to the common ink chamber 127M.

FIG. 7 shows an ink absorber 103C for reserving cyan ink and the ink supply path 107C therefore. Similarly to FIG. 6, the ink absorber 103C is in contact with a filter 107C, and the ink supply path 103C is formed between the filter 108C and the inkjet printing head 101.

In this embodiment, modified polyphenylene ether (hereinafter referred to as PPE) is adopted as molding material for forming walls of the ink storage section and the ink supply paths in the inkjet printing cartridge 100. The modified PPE is difficult to completely block off liquid and gas and allows a certain percentage thereof to permeate. Accordingly, it is unavoidable that the moisture in ink permeates the walls and evaporates in accordance with the environmental temperature and humidity as well as the time passage.

Since the walls 109*g*, 109*g*', 109*e*, and 109*e*' are in contact with the outer air, the moisture in ink contained in the ink supply paths 107C and 107Y evaporates outside of the inkjet printing cartridge 100 through these walls.

Also, since the outside surfaces of the walls 109*a* and 109*b* shown in FIG. 6 are also in contact with the outer air, the moisture in ink evaporates in the same manner as in the walls 109*g*, 109*g*', 109*e*, and 109*e*'. Also, since the outside surfaces of the walls 109*c* and 109*d* shown in FIG. 7 are in contact with the outer air, the moisture in ink evaporates in the same manner as in the walls 109*g*, 109*g*', 109*e* and 109*e*'.

Contrary thereto, the walls 110*a* and 110*b* forming the ink supply paths 107C and 107Y are also used for forming the ink storage section 102M, and either side surfaces thereof are not in contact with the outer air. Accordingly, the moisture of inks contained therein does not permeate the walls whereby the evaporation thereof hardly occurs through the walls 110*a* and 110*b*. Walls 109*h* and 109*h*' forming the ink supply path 107M are also used for forming the ink supply paths 107C and 107Y in the same manner as in the above-mentioned walls 110*a* and 110*b*, and either side surfaces thereof are not in contact with the outer air. For the same reason, no evaporation occurs in the walls 110*c* and 110*d*.

As mentioned above, while walls forming the inkjet printing cartridge 100 include those having the possibility of evaporation of the moisture contained in ink and those having no possibility thereof, whether or not the evaporation of the moisture contained in ink occurs is not caused by the difference in material forming the walls. The material forming all the walls is modified PPE, and whether or not the evaporation of the moisture contained in ink is determined by whether or not one side surface of the respective wall is in contact with the outer air.

In the inkjet printing cartridge 100, since the structure relating to yellow (Y) ink and that relating to cyan (C) ink are symmetrical, the description will made solely on the structure relating to cyan (C) ink and that relating to yellow (Y) ink will not be provided.

The evaporation amount of the moisture contained in ink increases in proportion to a total area of the wall surfaces in contact with the outer air. The total area of the wall surfaces in contact with the outer air in the walls forming the ink supply path 107M is smaller than the total area of the wall surfaces in contact with the outer air in the walls forming the ink supply path 107C. Accordingly, the evaporation amount of the moisture contained in ink within the ink supply path 107M is less than the evaporation amount of the moisture contained in ink within the ink supply path 107C. In this embodiment, the walls of the respective ink storage sections are structured so that the evaporation amount of the moisture contained in ink within the magenta ink storage section and that of the cyan ink storage section become equal to each other. In this regard, it may be structured so that the evaporation amount of the moisture contained in magenta ink within the ink storage section or within the same and the ink supply path is less than the evaporation amount of the moisture in cyan ink.

In this embodiment, a ratio of a total surface area of the walls in contact with the outer air among those forming the ink supply path 107M to a total surface area of the walls in contact with the outer air among those forming the ink supply path 107C is 1:5. Accordingly, a ratio of the evaporation amount of the moisture in magenta ink contained in the ink supply path 107M relative to the evaporation amount of the moisture in cyan ink contained in the ink supply path 107C is also about 1:5.

When the moisture contained in ink has evaporated, the ink viscosity increases to deteriorate the easiness of a first ejection after the interruption of the ejection of ink.

FIG. 8 is a table showing the estimation of the ejection easiness after a predetermined time has passed, when magenta ink is used according to this embodiment. Ejection interval in FIG. 8 stands for a maximum time interval of the interruption of the ejection after which the ejection starts in a stable manner. Three kinds of inks different in the evaporation amount of the moisture (2%, 10% and 0%) were used for the estimation. Two kinds of ejection openings (a large ejection opening 122Mb having the ink ejection rate of about 5.7 ng and a small ejection opening 122Ma having the ink ejection rate of about 2.4 ng) were used for the estimation.

As shown in FIG. 8, since the ejection openings 122Ma and 122Mb are different in opening area, the ejection easiness is different after the predetermined time has passed; that is, the ejection opening 122Ma having a smaller opening area is inferior to the ejection opening 122Mb. Also, since the ink viscosity rises as the moisture in the ink has evaporated, the ink from which has evaporated 10% moisture is inferior to the ink from which has evaporated no moisture (0%). Here, while the results using the ink from which has evaporated 2% moisture and that from which evaporated no moisture are the same, it is conceivable that since the difference in evaporation amount of the moisture is small; i.e., the difference in ink viscosity is negligible, there is no distinction in the results.

Since the ratio of the evaporation amount of the moisture in the ink supply path 107M relative to that in the ink supply path 107C is about 1:5, if the evaporation amount of the moisture from the ink supply path 107C is 10 g, for example, the evaporation amount of the moisture from the ink supply path 107M becomes 2 g. That is, the evaporation of the moisture in ink contained in the ink supply path 107M is more suppressed than the evaporation thereof in the ink supply path 107C, whereby the rise of the ink viscosity as well as the deterioration of the ejection easiness after the predetermined time interval has passed is also relieved.

By using such a characteristic, the ink used for the small ejection opening 122Ma having a smaller ejection amount and inferior in the ejection easiness after the predetermined time interval has passed in comparison with the other ejection opening is improved in the deterioration of the ejection easiness after the predetermined time interval has passed by minimizing the moisture evaporation through the walls of the ink supply path. Also, in a case of ink used for the other ejection openings than the small ejection opening (the large ejection openings), a structure is adopted wherein the evaporation amount of the moisture in the ink increases by an optional ratio in the ink supply path in comparison with the ink used for the small ejection opening 122Ma having a smaller ejection amount. Thereby, the ejection easiness after the predetermined time interval has passed becomes uniform between the large and small ejection openings, and the ejection stability is improved.

Since this method is not one wherein the ejection easiness after the predetermined time has passed is improved by the repetition of the preliminary ejection, the unnecessary consumption of ink is avoidable, whereby an amount of ink usable by the user is reducible to restrict the rise of the running cost. Also, since a structure of an ink storage section in the inkjet printing cartridge 100 is solely changed, it is possible to prevent the ejection easiness from deteriorating after the predetermined time has passed, without increasing the complexity of the structure and control.

The evaporation of the moisture in ink influences the colorant concentration of the ink. The colorant concentration of the ink is determined by the evaporation rate defined by a ratio of a volume of the ink relative to an amount of the evaporated moisture. When the colorant concentration in the ink varies with the respective color by the evaporation of the moisture contained in the ink, the color density and the color tone of an image recorded on the printing medium are changed to degrade the printing quality.

Accordingly, in this embodiment, the ink supply path 107C has a greater amount of ink than that contained in the ink supply path 107M since the number of walls in contact with the outer air in the former path is larger than that in the latter path. Thereby, it is possible to minimize the difference in the ink evaporation rate between the ink supply path 107M and the ink supply path 107C and suppress the degradation of the printing quality.

In such a manner, by reducing the evaporation amount of the moisture in the ink corresponding to the ejection opening having a larger ejection amount in comparison with that corresponding to the ejection opening having a smaller ejection amount, it is possible to suppress the deterioration of the ejection easiness of the latter ejection opening after the predetermined time has passed. In such a manner, the inkjet printing cartridge capable of ejecting miniaturized ink droplets in a stable manner is put into practice while suppressing the cost rise and avoiding the complexity of the structure as well as control.

Second Embodiment

A second embodiment of the present invention will be described below with reference to FIGS. 9 to 15.

Figure 9:
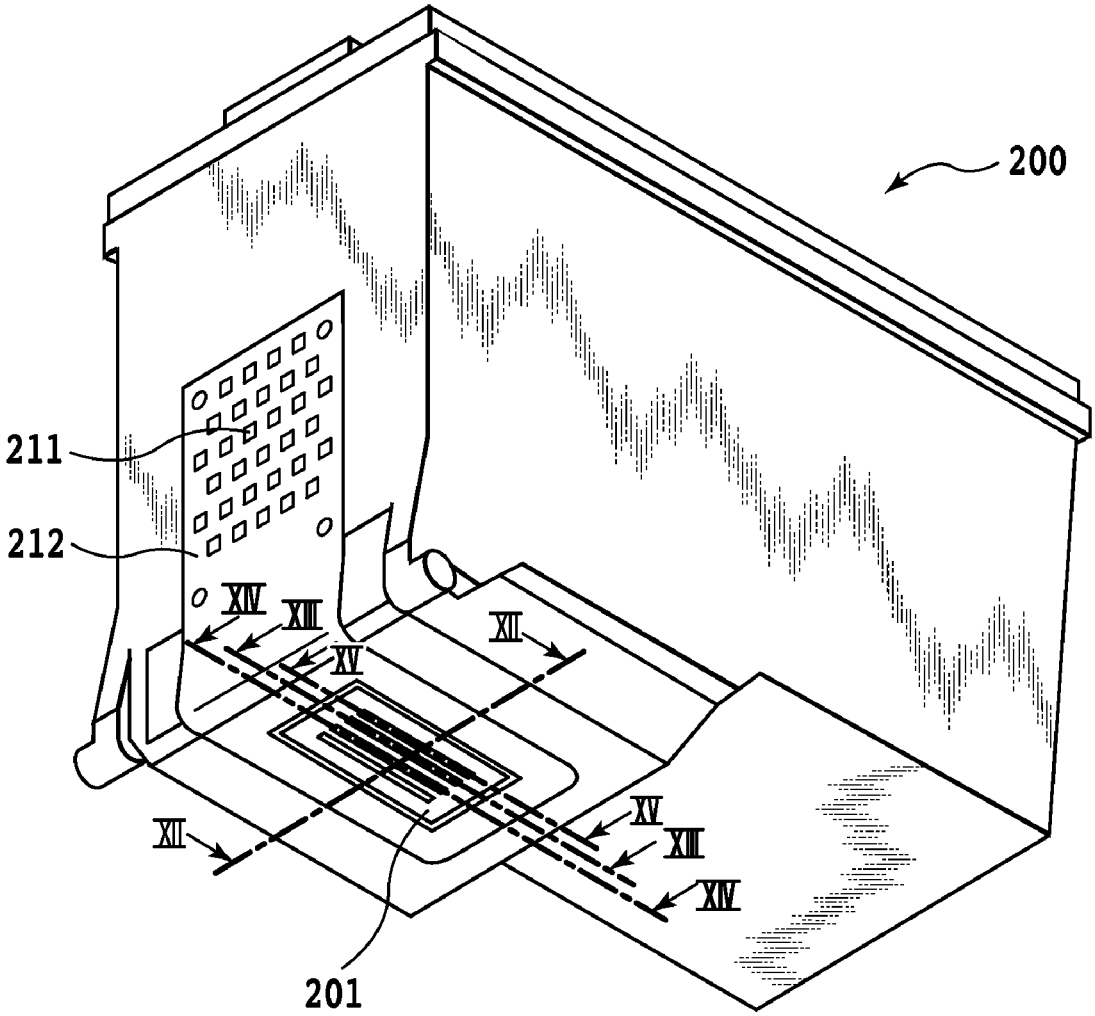
FIG. 9 is a perspective view of an appearance of an inkjet printing cartridge according to a second embodiment of the present invention.

FIG. 9 is a perspective view of the appearance of an inkjet printing cartridge 200 in this embodiment. The appearance of the inkjet printing cartridge 200 is approximately the same as the inkjet printing cartridge 100 in the first embodiment. Only one difference between the two is that, while the inkjet printing head 101 in the first embodiment has six rows of ejection openings (corresponding to three colors), that in this embodiment has eight rows of ejection openings (corresponding to four colors).

Figure 10:
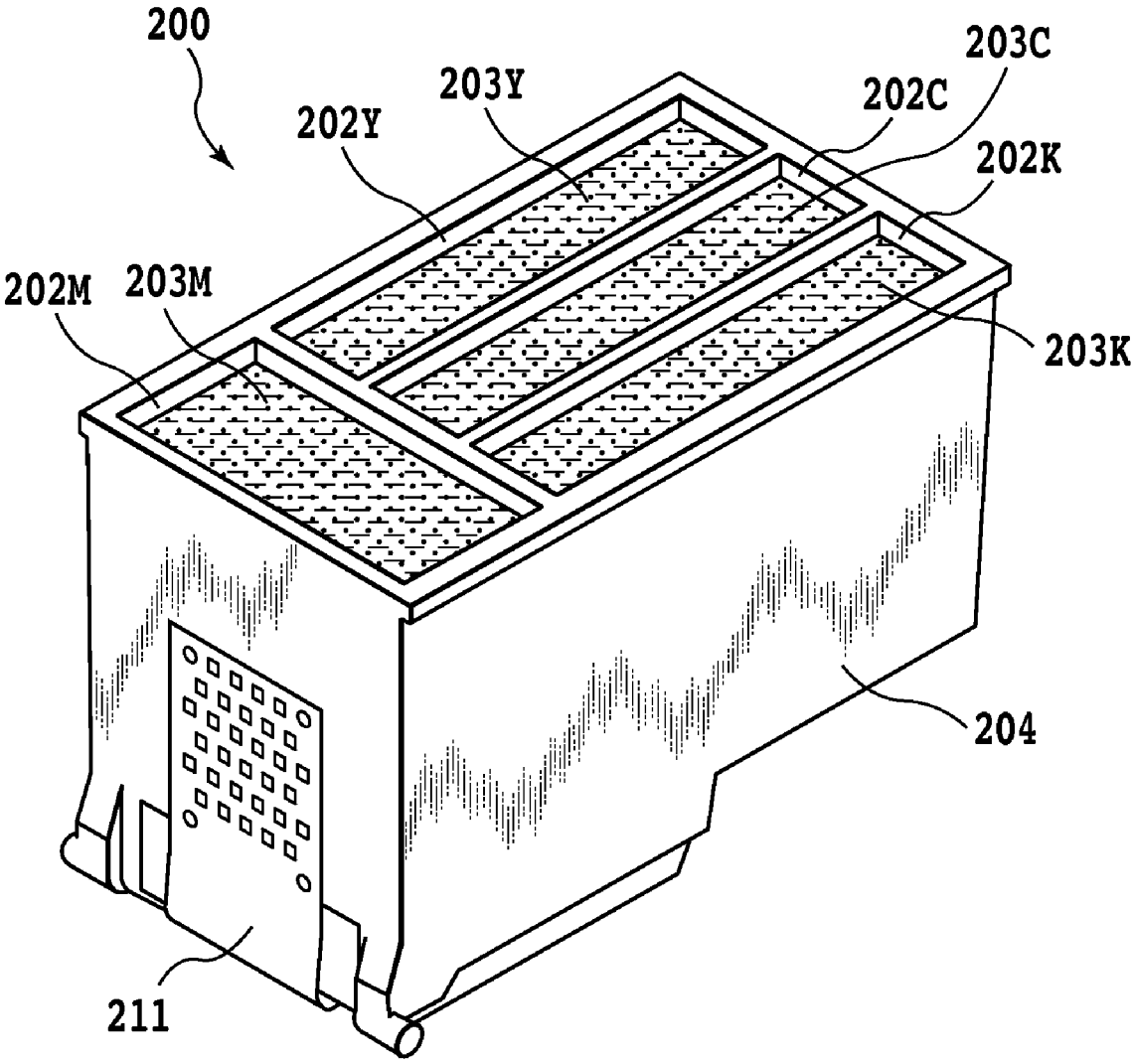
FIG. 10 is a perspective view of the inkjet printing cartridge in a state wherein a tank cover is removed.

FIG. 10 is a perspective view of the inkjet printing cartridge 200 illustrating a state wherein a tank cap is removed therefrom. The inkjet printing cartridge 200 according to this embodiment has a structure wherein each of cyan (C), magenta (M), yellow (Y), and black (B) inks has an ink storage section and an ink supply path. The ink printing cartridge 200 has ink storage sections 202C, 202M, 202Y and 202K for storing the respective color inks as illustrated in the drawing. In the respective ink storage sections 202C, 202M, 202Y, and 202K, there are ink absorbers 203C, 203M, 203Y, and 203K for containing and reserving the respective inks.

In general, when the printing operation is carried out while using four kinds of inks (black, cyan, magenta and yellow), black ink is used for not only printing characters but also inking into images formed with cyan, magenta, and yellow inks, and therefore, there are less chances used in a form of miniaturized ink droplets. Also, in an image wherein cyan, magenta, and yellow inks are used in the same ejection amount, cyan and magenta are more conspicuous in granular feeling than yellow. Accordingly, in a group of the four color inks (black, cyan, magenta and yellow), the miniaturization of cyan and magenta inks is effective for improving the printing quality. Thus, according to this embodiment, small ejection openings having a small ejection amount are provided for ejecting cyan and magenta inks.

Figure 11:
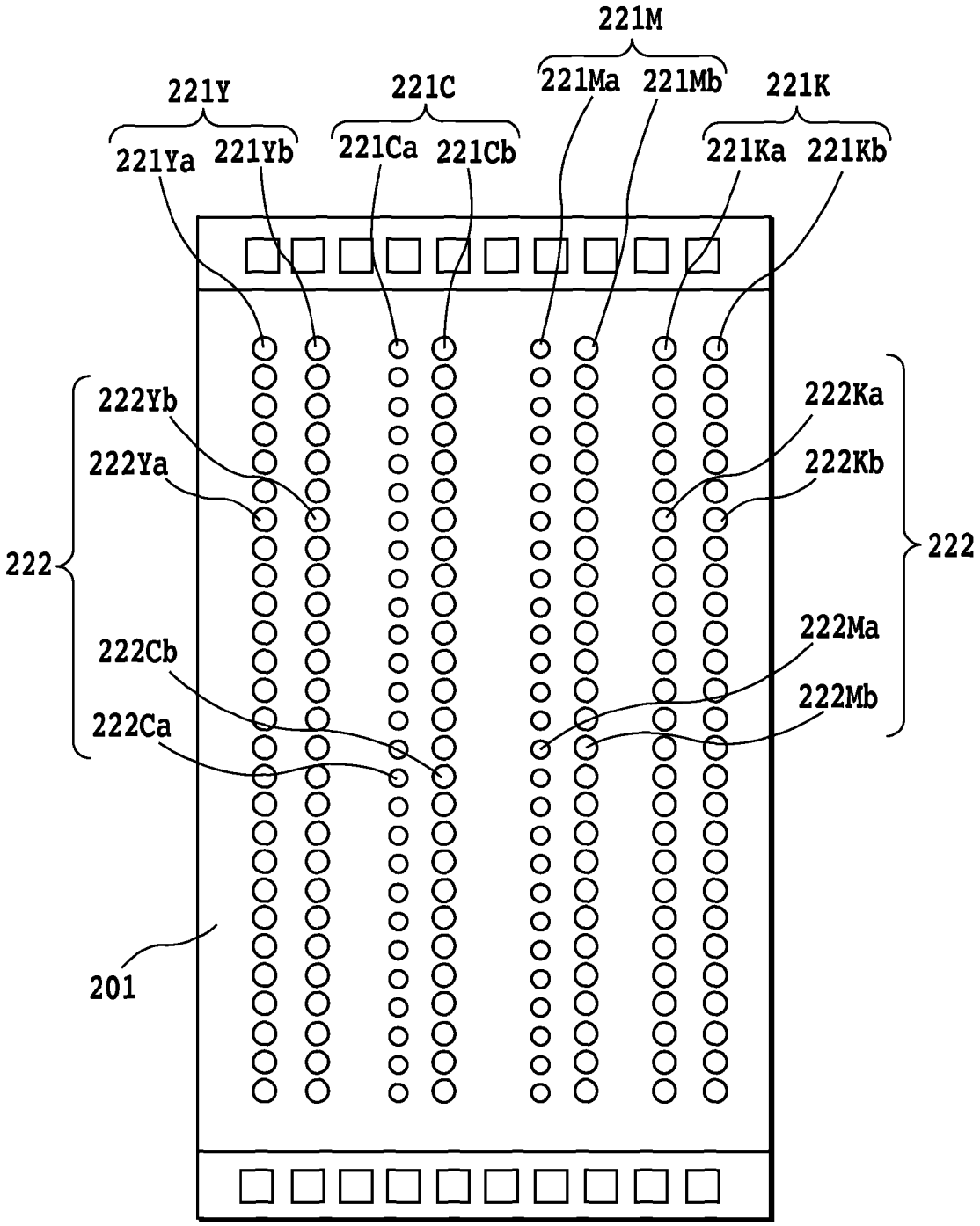
FIG. 11 is a plan view of an inkjet printing head according to the second embodiment.

FIG. 11 is a plan view of the inkjet printing head 201 according to this embodiment. Two rows 221C, 221M, 221Y, and 221K of ejection openings are provided corresponding to the respective inks. The rows of ejection openings for magenta and cyan inks are solely provided with small ejection opening rows 221Ma and 221Ca capable of ejecting a small amount of ink droplets. The ejection opening 222 has a circular shape wherein a diameter of the ejection openings 222Ma and 222Ca is 11 μm and a diameter of the ejection openings 222Mb and 222Cb is 17 μm. A diameter of the ejection openings 222Ka, 222Kb, 222Ya, and 222Yb is 17 μm that is the same as that of the 222Mb and 222Cb.

Structures of the heat element for generating energy for ejecting ink and the ink ejection opening for ejecting ink is the same as those shown in the first embodiment. Also, the ejection amount of ink per drop is the same as described above, about 2.4 ng for the ejection openings 222Ma and 222Ca having the diameter of 11 μm, and about 5.7 ng for the ejection openings 222Mb, 222Cb, 222Ka, 222Kb, 222Ya and 222Yb having the diameter of 17 μm.

Figure 12:
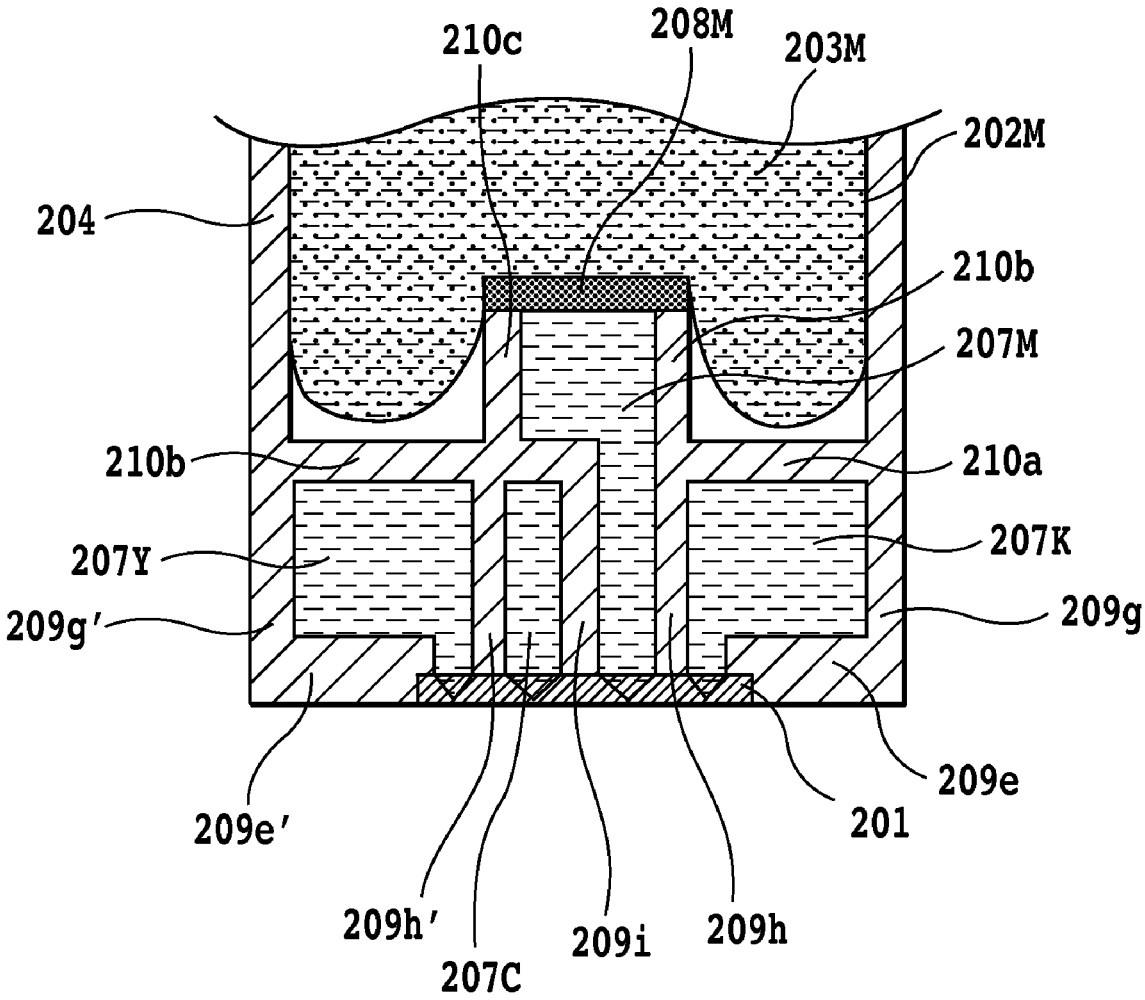
FIG. 12 illustrates a cross-section taken along a line XII-XII in FIG. 9.

FIG. 12 illustrates a cross-section taken along a line XII-XII in FIG. 9. As shown in FIG. 12, the ink supply path 207M containing magenta ink is arranged between the ink supply paths 207K and 207C containing black and cyan inks, respectively. Also, the ink supply path 207C containing cyan ink is arranged between the ink supply paths 207M and 207Y containing magenta and yellow inks, respectively. The ink supply paths 207K and 207Y have a larger inner volume than that of ink supply paths 207M and 207C so that a greater volume of ink is contained therein.

Figure 13:
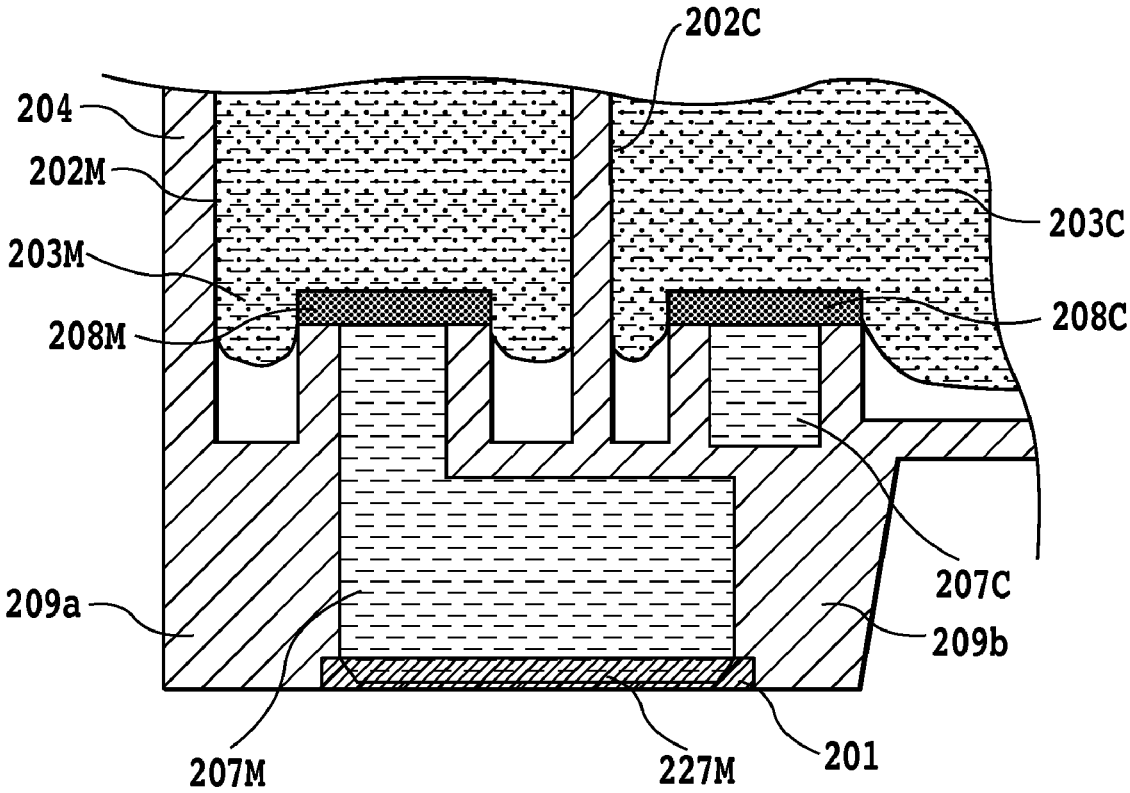
FIG. 13 illustrates a cross-section taken along a line XIII-XIII in FIG. 9, for explaining an ink supply path containing magenta ink.
Figure 14:
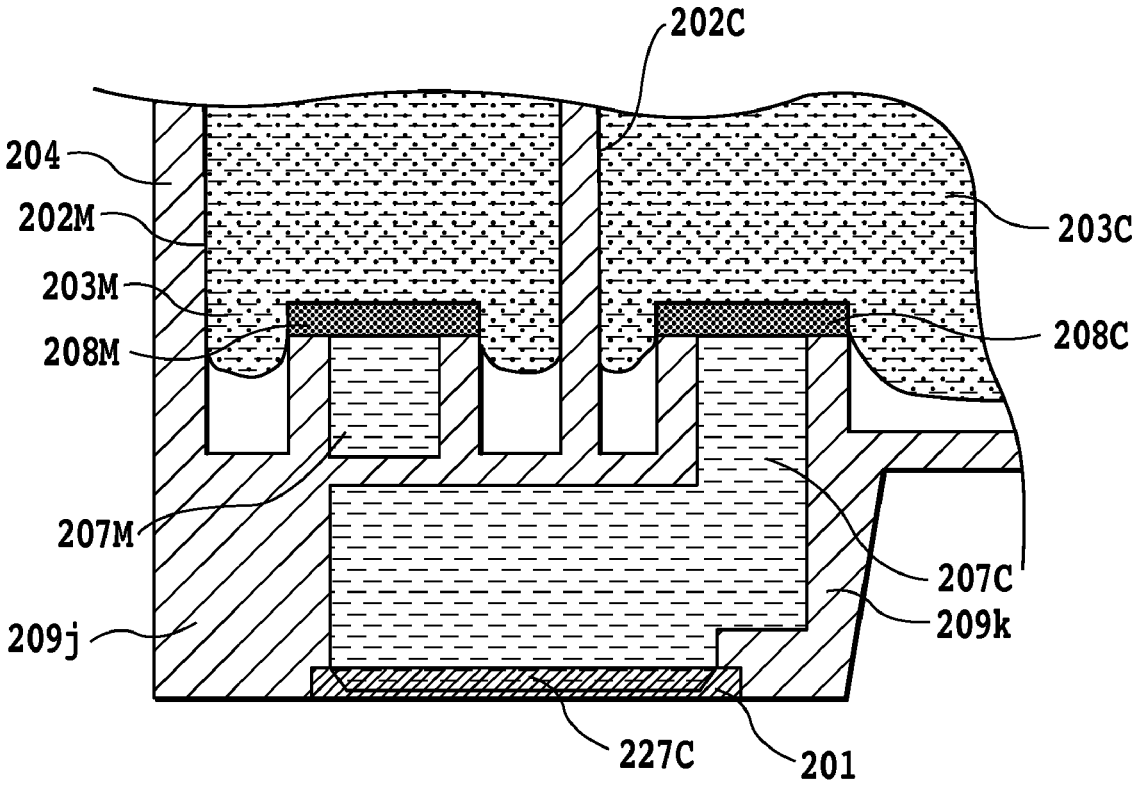
FIG. 14 illustrates a cross-section taken along a line XIV-XIV in FIG. 9, for explaining an ink supply path containing cyan ink.
Figure 15:
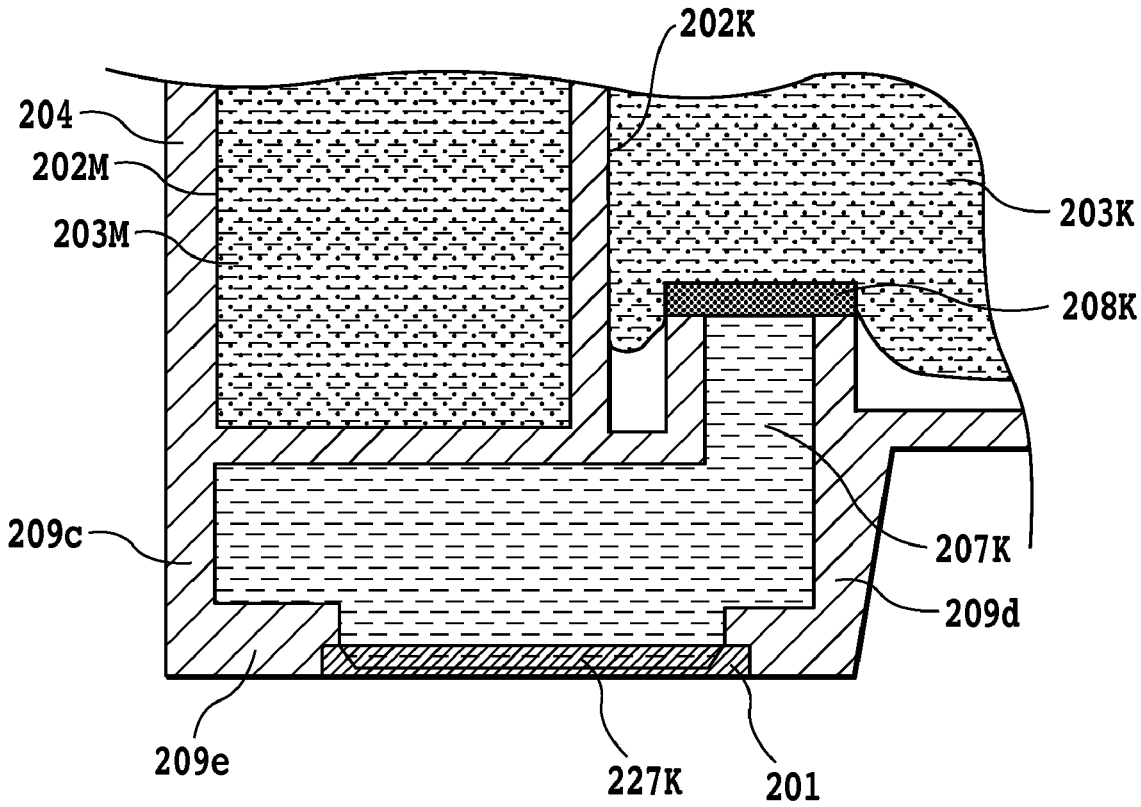
FIG. 15 illustrates a cross-section taken along a line XV-XV in FIG. 9, for explaining an ink supply path containing black ink.

FIG. 13 illustrates a cross-section taken along a line XIII-XIII in FIG. 9 for explaining the ink supply path 207M containing magenta ink. Similar to the first embodiment, a filter 208M is provided for preventing impurities from entering the ink absorber 203M and the inkjet printing head 201. Similarly, FIG. 14 illustrates a cross-section taken along a line XIV-XIV in FIG. 9 for explaining the ink supply path 207C containing cyan ink. FIG. 15 illustrates a cross-section taken along a line XV-XV in FIG. 9 for explaining the ink supply path 207K containing black ink.

Here, since modified PPE is adopted as the material for molding the inkjet printing cartridge 201 in the same manner as the first embodiment, the moisture in the ink contained in the ink supply path 207 permeates the walls in accordance with the environmental temperature and humidity as well as the time passage, and evaporates out of the ink supply path. In this regard, since the cyan ink storage section 202C has a smaller wall area in contact with outer air in a state wherein inks are filled in the respective ink storage sections, the evaporation amount of the moisture in the ink becomes less. The evaporation amounts of the moisture are equal to each other with respect to the magenta, yellow, and black inks.

No evaporation occurs through walls 209*h*, 209*h*', and 209*i*, both side surfaces of which define the ink supply paths, and walls 210*a*, 210*b*, or others, one side surface of which defines the ink storage section and the other defines the ink supply path, since they are not in contact with outer air. Contrary to this, however, the evaporation of the moisture in the ink contained in the ink supply paths occurs through walls 209*a*, 209*b*, 209*c*, or others in contact with the outer air via outside surfaces thereof. Accordingly, the evaporation of the moisture in cyan and magenta inks contained in the ink supply paths 207C and 207M is less than that in black and yellow inks contained in the ink supply paths 207K and 207Y, whereby the deterioration of the ejection easiness of the former inks after the predetermined time has passed is also improved.

As described above, in the ink storage section 202C, although the evaporation amount of the moisture in cyan ink becomes less than that in magenta ink, there is no problem since the reduction of the evaporation amount has no harmful effect on the ejection.

By using such difference in the evaporation amount of the moisture in ink, the evaporation amount of the moisture in ink is reduced in the ink used for the small ejection openings 222Ma and 222Ca less in the ejection amount as well as inferior in the ejection easiness after the predetermined time has passed. Thereby, it is possible to improve the deterioration of the ejection easiness in the small ejection openings 222Ma and 222Ca after the predetermined time pas passed. Thereby, the same ejection easiness is obtainable in the small ejection opening and the other ejection opening (large ejection opening) after the predetermined time has passed to improve the ejection stability.

The evaporation of the moisture in the ink also has some effect on the colorant concentration of the ink. The colorant concentration in the ink is determined by the evaporation rate defined by a ratio of a volume of ink to an amount of evaporated moisture. When the colorant concentration varies in accordance with respective colors by the evaporation of the moisture in the ink used for the printing, the color density and/or the color tone of images recorded on the printing medium also changes to degrade the printing quality.

To overcome such a drawback, according to this embodiment, the ink supply paths 207K and 207Y contain more amounts of ink than those in the ink supply paths 207M and 207C, respectively. This is because a wall area in contact with the outer air is large whereby a greater amount of moisture in the ink contained therein is evaporated. Accordingly, it is possible to prevent the difference between the evaporation rate of the ink contained in the ink supply paths 207M and 207C and that of the ink contained in the ink supply paths 207Y and 207K from increasing to suppress the lowering of the printing quality. In other words, by arranging the ink supply path for supplying ink to an ejection opening having a relatively lower ejection amount adjacent to the other ink supplying path via the wall, it is possible to suppress the evaporation of ink which ejection easiness becomes relatively worse after the predetermined time has passed.

In such a manner, regarding cyan and magenta inks in four kinds of inks (black, cyan, magenta and yellow), it is possible to eject miniaturized ink droplets in a stable manner whereby the inkjet printing cartridge capable of obtaining a high-image quality printing is put into practice.

Third Embodiment

A third embodiment of the present invention will be described below with reference to the attached drawings.

Figure 16:
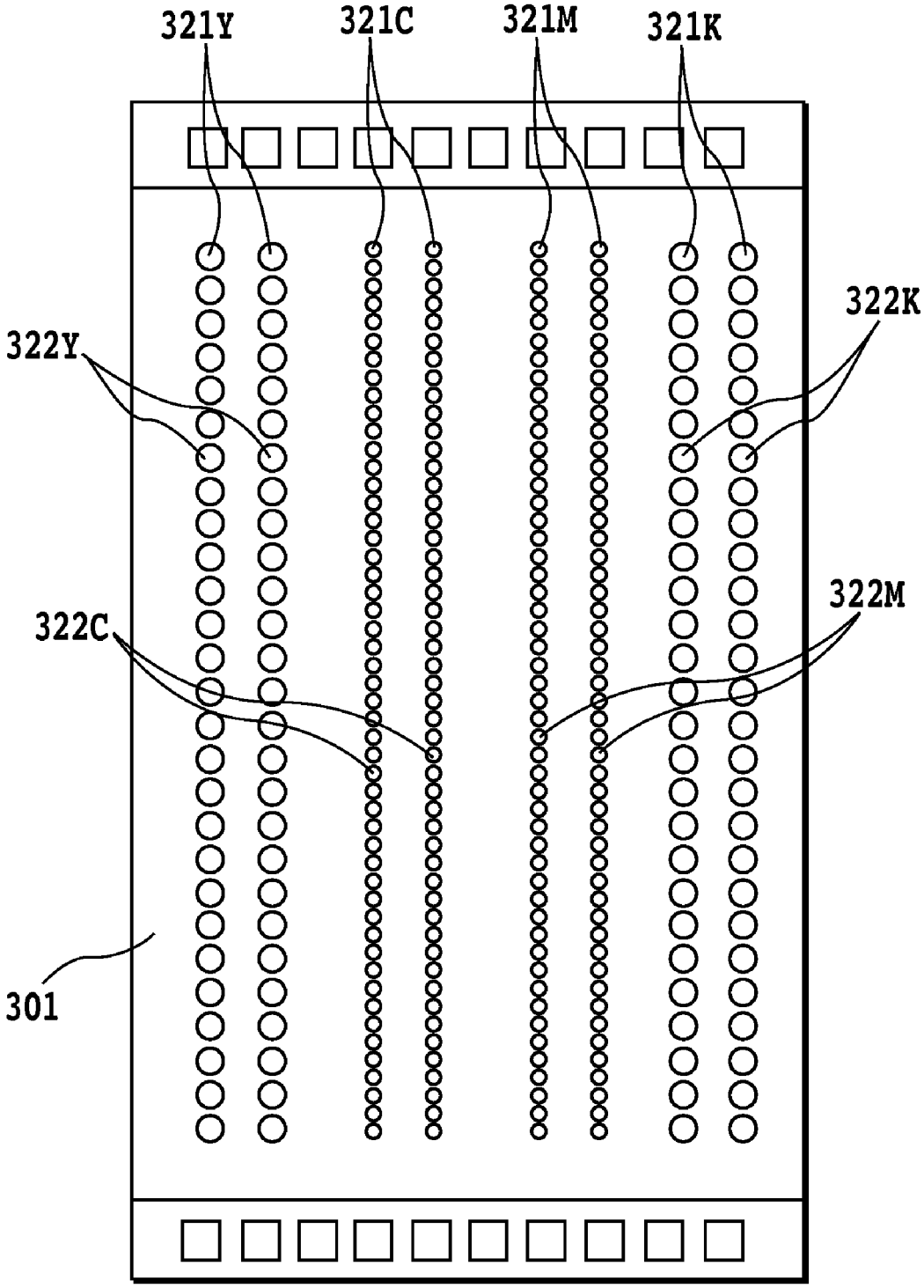
FIG. 16 is a plan view of an inkjet printing head according to a third embodiment of the present invention.

FIG. 16 is a plan view of an inkjet printing head 301 according to this embodiment. Only one difference in structure of this embodiment from that of the second embodiment is the arrangement of rows of ink ejection openings in the inkjet printing head 301. That is, the rows 221Cb and 221Mb of the ejection openings in the second embodiment (see FIG. 11) are changed to rows 321C and 321M of small ejection openings to increase the number of ejection openings. Since the other construction is the same as in the second embodiment, the explanation thereof will be eliminated.

According to this embodiment, the row of ejection openings for ejecting cyan and magenta inks uses no large ejection openings, but solely consists of small ejection openings. Also, since the number of ejection openings 322C and 322M are larger than those of the other ejection openings 321Y and 321K, the number of ejections increases by reducing the ink ejection amount, and as a result, it is possible to solve the problem of the deceleration of the printing speed. Further, since the ink ejection openings 322C and 322M are arranged at a high density, it is possible to solve the problem of the increase in size of the inkjet printing head caused by the increase in the number of ejection openings, as well as the cost rise accompanied therewith.

Other Embodiments

While the inkjet printing cartridge is adopted in the above-mentioned embodiments wherein three colors (cyan, magenta, and yellow) or four colors (black, cyan, magenta, and yellow) are integral with each other, the present invention should not be limited thereto. Other kinds of ink or the number of colors may be suitably selectable. Also, while modified polyphenylene ether (PPE) is adopted as the material for forming the inkjet printing cartridge, this is not limitative but any other material may be properly selectable in accordance with the moldability, the mechanical strength, the contour or others.

Further, while the combination of about 2.4 ng and about 5.7 ng is employed in the ink ejection amount, this is not limitative but other combination of the ink ejection amounts or the combination of different kinds of ink may be selectable if the magnitude relation of the ink ejection amounts is within a range defined by claims.

According to the above-mentioned embodiments, while the heat element is used as an element for generating the ink-ejection energy, this is not limitative. For example, a piezo element may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-104241, filed Apr. 11, 2007, which is hereby incorporated by reference herein in its entirety.

What is claimed is:

1. An inkjet printing head comprising:

an ink ejecting substrate having a plurality of ejection openings configured to eject ink at different ejection amounts;

a plurality of common ink chambers, a common ink chamber of the common ink chambers configured to supply the ink to the plurality of ejection openings; and a plurality of ink supply paths, an ink supply path of the ink supply paths configured to supply the ink to the common chamber, wherein the plurality of ejection openings having a relatively small ejection amount is provided ink from only the ink supply path other than the plurality of ink supply paths provided at both ends relative to an array direction in which the plurality of ink supply paths are aligned via the common ink chamber.

2. The inkjet printing head according to claim 1, wherein a volume of the ink supply paths provided at both ends relative to the array direction is larger than that of the ink supply path other than the ink supply paths at both ends relative to the array direction.

3. The inkjet printing head according to claim 1, wherein a number of the ejection openings of an ejection opening array consisting of the ejection openings having a relatively small ejection amount is larger than that of the ejection openings of an ejection opening array consisting of the ejection openings having a relatively large ejection amount.

4. The inkjet printing head according to claim 3, wherein an arrangement density of the ejection openings having a relatively small ejection amount is higher than that of the ejection openings having a relatively large ejection amount.

5. The inkjet printing head according to claim 1, further comprising an ink storage section separately stores cyan, magenta, and yellow inks.

6. The inkjet printing head according to claim 5, the colors of the inks ejected from the ejection opening having a relatively small ejection amount are cyan and magenta.

7. An inkjet printing cartridge comprising the inkjet printing head according to claim 1 and an ink tank mountable to the inkjet printing head.

8. An inkjet printing head according to claim 1, wherein the plurality of ejection openings eject a plurality of kinds of inks.

9. An inkjet printing cartridge comprising the inkjet printing head according to claim 1 and a ink storage section separately stores a plurality of kinds of inks, wherein the plurality of ink supply paths are integrated with the ink storage section.

10. An inkjet printing head comprising:

an ink ejecting substrate having a plurality of ejection openings configured to eject ink at different ejection amounts;

a plurality of common ink chambers, a common ink chamber of the plurality of common ink chambers configured to supply the ink to the plurality of ejection openings;

a plurality of ink supply paths, an ink supply path of the ink supply paths configured to supply the ink to the common ink chamber;

a first wall portion which is a back side portion of an inner wall forming the ink supply path supplying ink to at least for the plurality of ejection openings having a relatively small ejection amount via the common ink chamber; and a second wall portion which is a back side portion of an inner wall forming the ink supply path supplying the ink to the plurality of ejection openings other than the plurality of the ejection openings having a relatively small ejection amount via the common ink chamber, wherein a ratio of an area of a weathered first wall portion to a total area of the first wall portion is smaller than a ratio of an area of a weathered second wall portion to a total area of the second wall portion.

11. An inkjet printing head according to claim 10, further comprising a plurality of the first wall portions and a plurality of the second wall portions.

* * * * *